United States Patent [19]

Nercessian

[11] 4,012,685

[45] Mar. 15, 1977

[54] REGULATED POWER SUPPLY FOR VERY HIGH CURRENT WITH VOLTAGE AND CURRENT PROGRAMMABLE TO ZERO

[75] Inventor: Sarkis Nercessian, Flushing, N.Y.

[73] Assignee: Forbro Design Corporation, New York, N.Y.

[22] Filed: Mar. 14, 1974

[21] Appl. No.: 451,302

Related U.S. Application Data

[63] Continuation of Ser. No. 343,792, March 22, 1973, abandoned.

[52] U.S. Cl. ..... 323/20; 307/48; 307/53; 323/25

[51] Int. Cl.[2] ..... G05F 1/56

[58] Field of Search ..... 307/44, 48, 51, 52, 307/53, 60; 321/18; 323/4, 20, 22 T, 23, 25, 40

[56] References Cited

UNITED STATES PATENTS

| | | | |
|---|---|---|---|
| 3,001,082 | 9/1961 | Clarke | 307/53 X |
| 3,152,296 | 10/1964 | Meszaros | 321/18 |
| 3,305,763 | 2/1967 | Kupferberg et al. | 323/22 T |
| 3,356,855 | 12/1967 | Suzuki et al. | 307/53 |
| 3,411,014 | 11/1968 | Kupferberg | 323/40 UX |
| 3,416,066 | 12/1968 | Bourreau et al. | 323/25 X |
| 3,466,455 | 9/1969 | Hecht et al. | 307/53 |
| 3,487,291 | 12/1969 | Dowgiallo | 323/20 X |
| 3,508,081 | 4/1970 | Matsuda | 323/4 UX |
| 3,659,189 | 4/1972 | Kiviranna | 323/40 X |
| 3,704,381 | 11/1972 | Nercessian | 323/25 X |

OTHER PUBLICATIONS

Klein, "Dual Response Regulator", IBM Technical Disclosure Bulletin, vol. 10, No. 8, Jan. 1968, pp. 1212, 1213.

*Primary Examiner*—A. D. Pellinen
*Attorney, Agent, or Firm*—Alfred W. Barber

[57] ABSTRACT

A first low voltage power supply having silicon controlled rectifier regulation in the primary of the power transformer, capable of supplying very high direct current, and a second well regulated feedback power supply providing a fixed current in reverse polarity are connected in parallel across a load. The first power supply is feedback controlled to maintain constant current sinking in the second power supply. The second power supply is programmed to regulate the load current or voltage, to provide fine regulation at the load, and to reduce ripple voltage at the load.

1 Claim, 4 Drawing Figures

REGULATED POWER SUPPLY FOR VERY HIGH CURRENT WITH VOLTAGE AND CURRENT PROGRAMMABLE TO ZERO

This is a continuation of application Ser. No. 343,792 now abandoned filed Mar. 22, 1973.

A highly regulated relatively low power supply has been combined with a less well regulated but much higher power power supply to provide high and well regulated sum current to a load. Such a system is shown and described in U.S. Pat. No. 3,704,381. The highly regulated power supply senses the load current and provides the current control and regulation. The higher power power supply senses the difference between the current provided by the first supply and a predetermined fraction of the current provided by the second supply and by feedback regulation keeps the difference essentially zero. Thus, a predetermined fixed ratio of current is maintained from the two supplies. Such a system works well at high current levels but regulation suffers if the total current is programmed to a low value.

A modification of the above system is to keep the current in the regulating supply constant. While such a system has the advantage of maintaining a fixed preload on the high power supply, it does not permit the load current to be programmed to a value less than the current at which the fixed current supply is set.

SUMMARY:

I have found a novel solution to the problems mentioned above. The basis for this solution is to use the second power supply as a constant current sink. The first or main power supply is a primary controlled Silicon controlled rectifier current regulator programmed to maintain the current in the current sink supply constant. The load voltage and the load current are varied by programming the current sink supply. The current sink supply provides voltage or current regulation, current fold-back on overload and ripple filtering by means of high gain feedback circuits.

A single choke aids in the filtering and provides current limiting in case of short-circuit across the output. Remote turn-on is provided by activating the Silicon controlled rectifiers and this same circuit provides turn-off without high current interruption in case of short-circuit of the power supply. Additional protection is provided by individual circuit-breakers in each Silicon controlled rectifier circuit, protecting the supply in case of short-circuit of any Silicon controlled rectifier.

Figure 1:
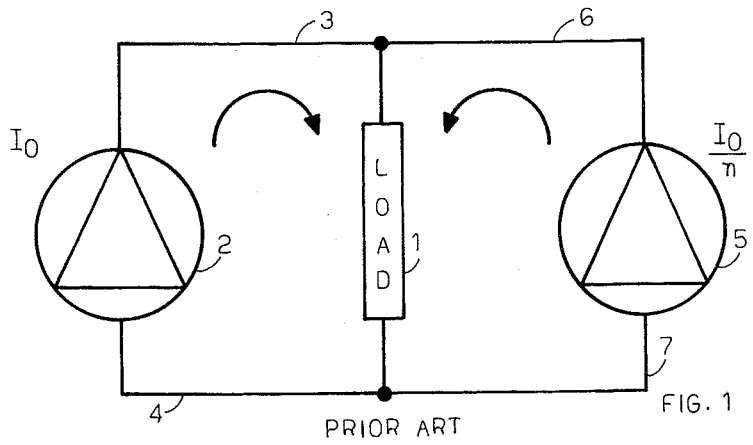
FIG. 1 is a simplified circuit of the prior art proportioned parallel power supplies.

FIG. 1 is a simplified block diagram of the prior art method of regulating a relatively high current by means of a relatively low current (see above reference patent). The main or larger current $I_o$ may be less well regulated than the required regulation of the total load current. A highly regulated current fractionally related to $I_o$, namely a current $I_o/n$ is added and controlled in accordance with the total load current so that the total load current is provided with a high degree of regulation. This system operates well at relatively high current values but degenerates as the load current is programmed to very low values in which case $I_o/n$ becomes too small to be closely controlled.

Figure 2:
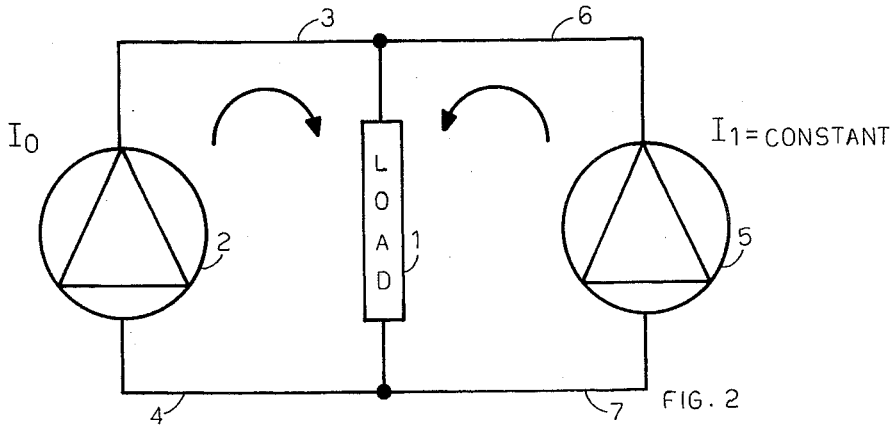
FIG. 2 is a simplified circuit of two paralleled power supplies in which one is kept at constant current output.

FIG. 2 shows how this degeneration of the control current can be prevented i.e., by making the control current $I_1$ assume a constant value. The problem now arises in that the system cannot be programmed to a lower total load current than the value of this control current $I_1$.

Figure 3:
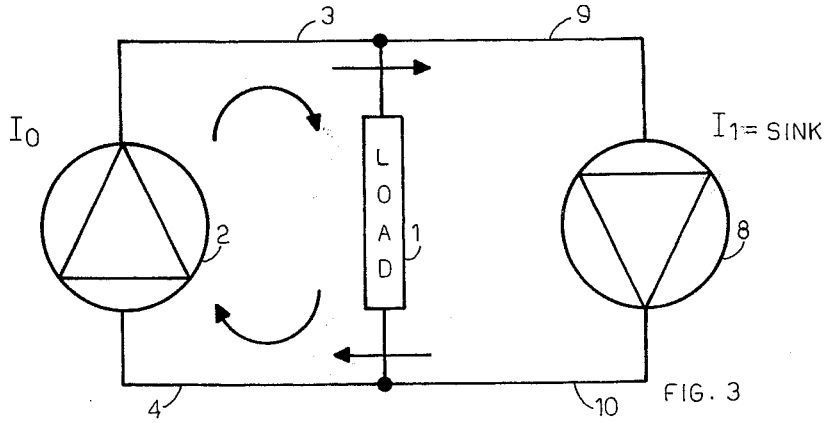
FIG. 3 is a simplified circuit of a power supply in accordance with the present invention.

FIG. 3 shows how the problems of FIGS. 1 and 2 can be overcome and some further advantages gained. The control current $I_1$ in FIG. 3 is passed through the load in the opposite direction to the direction of the main current $I_o$. The load current will now be zero when $I_o = I_1$. If both $I_o$ and $I_1$ are currents of substantial value, $I_o$ can be closely controlled. Since the minimum value of $I_o$ will be equal to $I_1$, current $I_1$ provides a constant preload further simplifying precise control. Thus, $I_1$ is a current sink i.e. it robs current from the load. Other features and advantages of this basic current will be set forth and described below in connection with the description of the more detailed circuits.

Figure 4:
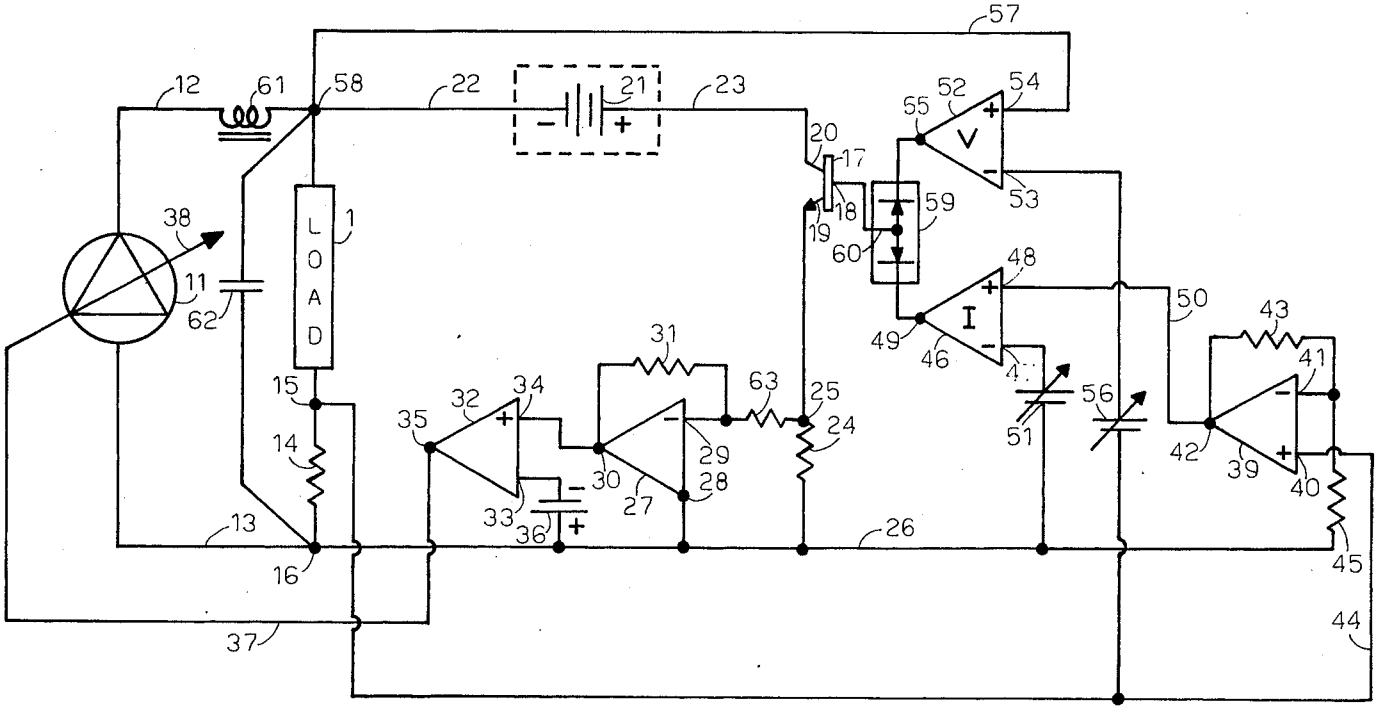
FIG. 4 is a block diagram of a power supply in accordance with the preferred form of the present invention.

FIG. 4 is a block diagram showing the essential components of a power supply in accordance with the present invention and based on the symbolic form of FIG. 3. Load 1 is connected in series with current sensing resistor 14 which in turn is connected between terminals 15 and 16. One load terminal is at 58 and the other at 15. The series combination of load and current sensing resistor is supplied with current ($I_o$) from a suitable current source 11 over leads 12 and 13. The current source 11 is controlled by a suitable means 38 by means of control signals supplied over lead 37. Current source 11 and control 38 are to be taken to represent any suitable voltage controllable current source. The balance of the circuit, to the right of the load, provides the fine regulating function of the invention. This regulating means corrects for any lack of regulation in the main current source 11 and thereby provides a highly regulated current or voltage in load 1.

The fine regulating circuit provides a current sink across load 1 and current sensing resistor 14 in series. Pass transistor 17 is connected through voltage source 21 and current sensing resistor 24 and over leads 22, 23 and 26 across the load 1 and current sensing resistor 14. This pass transistor is driven in such a manner as to control the load voltage or current and to provide the fine regulation as will be set forth more fully below. At the same time current source 11 is controlled in such a manner as to keep the current drawn by pass transistor 17 constant. This is done by amplifying the voltage across current sensing resistor 24 in series with pass transistor 17 by means of amplifier 27 operated at set gain as determined by the ratio of resistor 31 to resistor 63. The amplified voltage at output terminal 30 is compared with reference voltage 36 at input terminals 34 and 33 respectively of operational amplifier 32. The output at output terminal 35 is applied to control current source 11 symbolically represented by arrow 38. Whenever the voltage across current sensing resistor 24 deviates from its preset value, the circuit just described provides a corrective action to restore the sink current to its predetermined or preset value.

The current through load 1 is sensed by current sensing resistor 14 and the resulting voltage drop is amplified by operational amplifier 39 by a predetermined factor determined by the ratio of resistor 43 to resistor 45. The amplified voltage at output terminal 42 is compared with an adjustable reference voltage 51 at input terminals 48 and 47 respectively of operational amplifier 46. The resulting output current control voltage at output terminal 49 is applied through gate 59 and over lead 60 to base 18 of pass transistor 17. Thus the load current is controlled by the preset voltage of voltage reference 51.

Load voltage control is provided by operational amplifier 52 having input 54 connected over lead 57 to high load terminal 58 and input 53 connected to a source of adjustable reference voltage 56. Output terminal 55 is connected to gate 59 and over lead 60 to base 18 of pass transistor 17.

The current and voltage controls described above will be seen to be those of a conventional dual bridge controlled cross-over power supply except for the fact that pass transistor is absorbing current rather than supplying current. This fine regulating circuit supplies the fine regulation of load voltage or current. It operates at a substantial current at all times even when the load voltage or current are very low or even zero so that a stiff control is provided at all times. The fine regulating circuit also acts as a preload on the main current source 11 so that its operating characteristics are enhanced by not being forced to operate over a very wide range. Typical operation of this system is load current programmable from 0 to 600 amperes at load voltages from 0 to 50 volts and with a fixed current of 50 amperes drawn by the sink regulator. The voltage source 21 may be omitted in which event, the output voltage range will be restricted to a minimum voltage sufficient to provide bias to the main regulating transistor 17.

Current source 11 may be taken to represent a controllable dc source such as would be supplied by silicon controlled rectifiers. A minimum of filtering of this source is required since the fine regulator acts as a dynamic ripple and transient filter. A relatively low inductance choke 61 and shunt capacitor 62 may provide this minimum filtering. The small value of capacitor 62 provides a high speed regulating capability. The choke 61 also provides short-circuit current limiting for the system. If the ac source is a three phase source, capacitor 62 may be omitted.

I claim:

1. In a regulated DC power supply, the combination of;

a source of DC current;

means for controlling said current;

a pair of load terminals connected through a first current sensing resistor and an inductor to said source;

a controllable impedance current sink, a source of DC voltage and a second current sensing resistor all connected in series across the series circuit comprising said load terminals and the first said current sensing resistor;

voltage and current feedback means gated to control said current sink for programming the current and voltage to said load terminals;

means for keeping the current in said sink constant from the maximum output voltage which the power supply is capable of supplying down to zero output voltage including degenerative feedback means connected between said second current sensing resistor and said means for controlling said current and including said source of DC voltage;

wherein said source of DC voltage is sufficient to provide said constant current to said sink at zero voltage across said load terminals.

* * * * *